US008839557B2

(12) United States Patent
Sheldon

(10) Patent No.: US 8,839,557 B2
(45) Date of Patent: Sep. 23, 2014

(54) AUTOMATIC DOOR CLOSER

(71) Applicant: JCV Enterprises, Centennial, CO (US)

(72) Inventor: James Lloyd Sheldon, Centennial, CO (US)

( * ) Notice: Subject to any disclaimer, the term of this patent is extended or adjusted under 35 U.S.C. 154(b) by 0 days.

(21) Appl. No.: 13/734,618

(22) Filed: Jan. 4, 2013

(65) Prior Publication Data

US 2014/0190082 A1 Jul. 10, 2014

Related U.S. Application Data

(63) Continuation-in-part of application No. 13/217,683, filed on Aug. 25, 2011, now abandoned.

(60) Provisional application No. 61/379,347, filed on Sep. 1, 2010.

(51) Int. Cl.
*E05F 11/00* (2006.01)
*E05F 15/20* (2006.01)

(52) U.S. Cl.
CPC ..... *E05F 15/2092* (2013.01)
USPC ..... 49/199; 49/30

(58) Field of Classification Search
USPC ..... 49/197, 199, 200, 29, 30; 318/264–266, 318/272, 275, 277, 282, 286, 466–469
See application file for complete search history.

(56) References Cited

U.S. PATENT DOCUMENTS 4,035,702 A * 7/1977 Pettersen et al. ..... 318/285
5,357,183 A * 10/1994 Lin ..... 318/468
5,752,343 A * 5/1998 Quintus ..... 49/29
6,469,464 B1 * 10/2002 McCall ..... 318/445
6,563,278 B2 * 5/2003 Roman ..... 318/282
7,600,550 B2 * 10/2009 Mays ..... 160/188
2004/0216379 A1 * 11/2004 Gioia et al. ..... 49/29
2006/0150511 A1 * 7/2006 Parsadayan ..... 49/29
2013/0227886 A1 * 9/2013 Kurth et al. ..... 49/30

OTHER PUBLICATIONS

Press, Richardson, TX, Home Automation, Nov. 2003, "Close Sesamel," www.autocloser.com, 1 page.
Garage Door Closer, Novalert, LLC, 1 page.
Press, Richardson, TX—Feb. 2004, International Door & Operator Industry magazine, "Xceltronix Announces Autocloser: Device Cuts Crime by Automatically Closing an Open Garage Door," 1 page.
Press, Richardson, TX—Jun. 6, 2003, "New Product Responds to Trend of Garage Burglaries Plaguing Metroplitan Areas," 1 page.

* cited by examiner

*Primary Examiner* — Katherine Mitchell
*Assistant Examiner* — Catherine A Kelly
(74) *Attorney, Agent, or Firm* — Klaas, Law, O'Meara & Malkin PC; Robert W. Nelson, Esq.

(57) ABSTRACT

Control devices that operate automatic door controllers and methods of operating automatic door controllers are disclosed. An embodiment of controller control device that operates with an automatic door closer includes a sensor that is attached to the door, the sensor operable to transmit data indicative of the orientation of the door. The controller also includes a receiver that is operable to receive the data from the sensor; monitor the orientation of the door based on the data received from the sensor; transmit a door closing instruction to the automatic door closer when the door orientation has been open for a first period; and pause the transmitting of door closing information to the automatic door closer for a second period when a pause input is received from a user.

18 Claims, 7 Drawing Sheets

AUTOMATIC DOOR CLOSER

CROSS REFERENCE TO RELATED APPLICATIONS

The present application is a continuation in part of U.S. patent application Ser. No. 13/217,683 entitled "Automatic Door Closer", filed on Aug. 25, 2011, which claimed priority to U.S. provisional patent application 61/379,347 entitled "Automatic Door Closer", filed Sep. 1, 2010, the entirety of which are incorporated herein by reference for all purposes.

BACKGROUND

Power or automatic door openers and/or closers, such a garage door openers/closers, open and close their respective doors at the press of a button. In some situations, a door can be inadvertently left open, which can be a security risk. Therefore, it is generally important to verify that the door has been fully closed when the area of the door is going to be left unattended. Checking the status of the door can be difficult when multiple people have access to the door, such as children who may not remember to close it. Furthermore, doors may be temporarily left fully or partially open for venting or other purposes, requiring the user to remember to close them at a later time.

SUMMARY

Control devices that operate automatic door controllers and methods of operating automatic door controllers are disclosed. An embodiment of controller control device that operates with an automatic door closer includes a sensor that is attached to the door, the sensor operable to transmit data indicative of the orientation of the door. The controller also includes a receiver that is operable to receive the data from the sensor; monitor the orientation of the door based on the data received from the sensor; transmit a door closing instruction to the automatic door closer when the door orientation has been open for a first period; and pause the transmitting of door closing information to the automatic door closer for a second period when a pause input is received from a user.

BRIEF DESCRIPTION OF THE DRAWINGS

A further understanding of the various embodiments of the present invention may be realized by reference to the figures which are described in remaining portions of the specification. In the figures, like reference numerals may be used throughout several drawings to refer to similar components.

DETAILED DESCRIPTION

The drawings and description, in general, disclose various embodiments of a control device for controlling an automatic door opener/closer. The door opener/closer is sometimes referred to herein simply as the garage door closer or a mechanical device that changes the orientation of a door. The control device may include a sensor and transmitter mounted to a door, such as an overhead door, and a receiver connected to a garage door closer. The control device causes the door closer to automatically close the door after a delay. The delay may be paused for a period by a user on a one-time basis. For example, the control device may be set to automatically close the door if the door is ever open for a period of fifteen minutes. However, there may be one-time situations where the door needs to stay open for a long period of time, wherein after the long period, the door is to be closed after the above-described delay. The user may instruct the control device to pause the automatic door closing for a period, such as eight hours, after which, the control device will resume the process of closing the door after it has been left open for the delay period.

The control device can be easily connected to existing door closers such as conventional garage door openers/closers. In some embodiments, the receiver is connected to a garage door opener button or switch and draws power from the wiring to the button, so that power is maintained to the control device even when the garage door opener button is pressed.

The term "door closer" is used broadly herein to refer to any powered door opener and/or closer, and does not imply that the control device is limited to use on the door of a garage. Rather, the control device may be used with any overhead door or other door to which a sensor can be attached to detect whether the door is open or closed, and which can be automatically closed by the automatic door closer.

Figure 1:
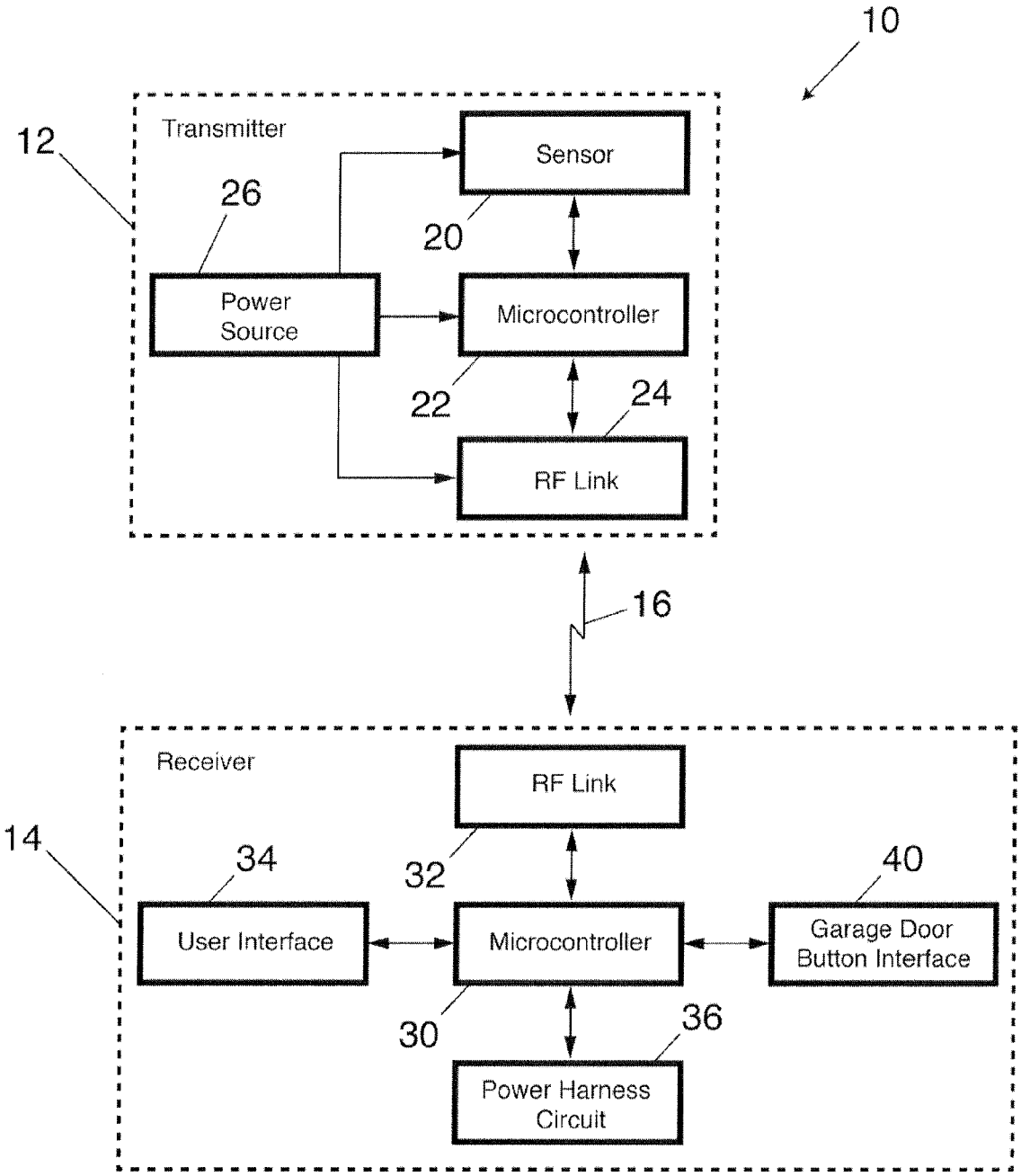
FIG. 1 depicts a block diagram of a wirelessly coupled transmitter and receiver in an automatic door closer in accordance with some embodiments of the present invention.

Turning now to FIG. 1, the control device 10 includes a transmitter 12, which is attached to the door to be monitored and closed, and a receiver 14 that may be connected to a door closer (not shown). The transmitter 12 and receiver 14 are in wireless communication using a radio frequency (RF) link 16 or other type of wireless connection. The transmitter 12 includes a position sensor 20 that detects the position of the door to which it is attached. The sensor 20 may comprise any suitable sensor for detecting the position or orientation of the door, such as a mercury switch, accelerometer, mechanical switch, proximity sensor, RFID, RF, RSSI, ball bearing tilt sensor, magnetic reed switch, optical or inductive sensors, ultrasonic sensors, infrared transmitter/receivers, etc.

In some embodiments, the transmitter 12 includes a microcontroller 22 that controls the operation of the transmitter 12 and that may read position information from the sensor 20 either periodically or continuously. The microcontroller 22 transmits door position or orientation information to the receiver 14 using an RF link 24 in the transmitter 12, or any other suitable wireless link. The sensor 20, microcontroller 22 and RF link 24 are powered by a power source 26 such as a battery. Power status in the transmitter 12 may be reported to users, for example by transmitting power status to the receiver 14 for display, or by displaying power status on the transmitter 12 with a status light-emitting diode (LED) or other display device (not shown in FIG. 1). The microcontroller 22 is replaced in some embodiments of the transmitter 12 by other devices such as a state machine, application specific integrated circuit (ASIC), programmable gate array (PGA), discrete logic circuits, etc.

Some embodiments of the receiver 14 includes a microcontroller 30 to control the operation of the receiver 14. In other embodiments, the microcontroller 30 is replaced by other devices such as a state machine, discrete logic circuits, etc. The microcontroller 30 in the receiver 14 communicates with the transmitter 12 using an RF link 32 to obtain door position or orientation information. As described above, the power status of the transmitter 12 may be transmitted to the receiver 14 where it is processed by the microcontroller 30. The microcontroller 30 automatically causes the door closer to close the door according to a number of control schemes, which are referred to as closing the door. For example, in some embodiments, the microcontroller 30 causes the door closer to close the door after a user-selected delay and if the transmitter 12 reports that the door is not fully closed. The microcontroller 30 also provides a user interface 34 in the receiver 14 that controls input devices, such as pushbuttons, and displays information on display devices, such as LEDs.

In some embodiments, the microcontroller 30, RF link 32 and user interface 34 draw power from a power harness circuit 36 connected to a garage door button interface 40. When the switch in the garage door button interface 40 is not being pressed by a user, a voltage potential appears across the terminals of the switch, and the power harness circuit 36 draws power from this voltage potential. The power harness circuit 36 also stores power so that when the switch in the garage door button interface 40 is closed and the voltage potential drops momentarily, the power harness circuit 36 is able to continue to power the receiver 14. In other embodiments, the receiver 14 is powered from other sources such as a battery or an external power supply.

During operation, the microcontroller 30 monitors the door position as reported by the transmitter 12 and processes data from the user interface 34. If the user interface 34 is programmed to close the door, and the transmitter 12 reports that the door is not closed, the microcontroller 30 causes the door to close by actuating the garage door button interface 40. For example, the door closer may be designed to cause the door to close by pressing a button to create an electrical connection between two terminals. In such embodiments, the garage door button interface 40 is connected across the two terminals, and the microcontroller 30 causes the door to close by creating an electrical connection between the two terminals in the garage door button interface 40.

Figure 2:
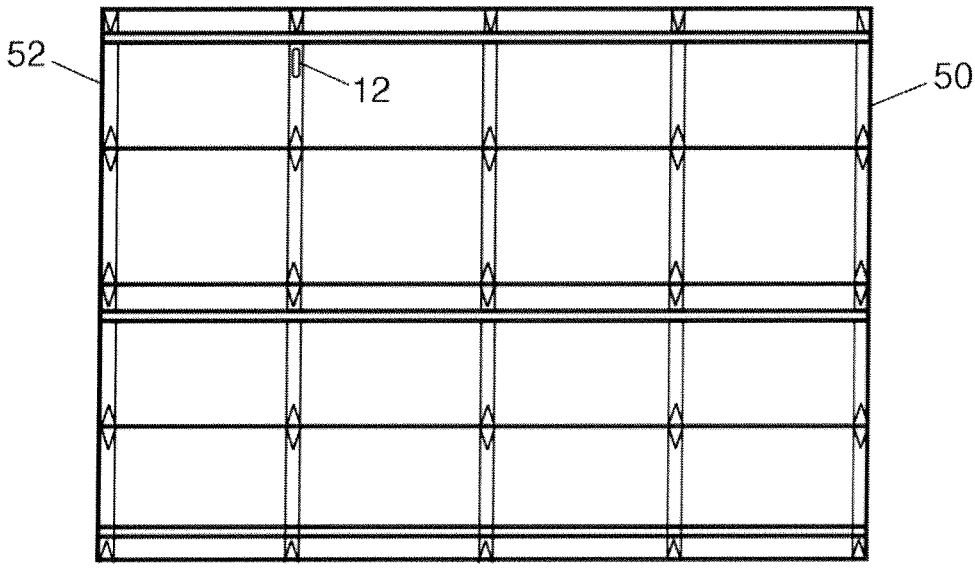
FIG. 2 depicts an overhead door with transmitter mounted thereon in accordance with some embodiments of the present invention.

Reference is made to FIG. 2, which illustrates a garage door, sometimes referred to as an overhead door or simply a door 50, on which the transmitter 12 may be mounted. In this example, the door 50 is made of a number of horizontal panels (e.g., 52), with the transmitter 12 mounted to the top panel 52. The top panel 52 is in the fully vertical position only when the door 50 is closed, otherwise, the top panel 52 will be in an angled or horizontal orientation. In this embodiment, the sensor 20 is adapted to detect when the top panel 52 to which it is attached is in the fully vertical position or not. If the top panel 52 is not fully vertical, then the door 50 is open or partially open. The transmitter 12 may be attached to the door 50 in any suitable manner, such as with screws, double sided tape, adhesives, etc.

Figure 3A:
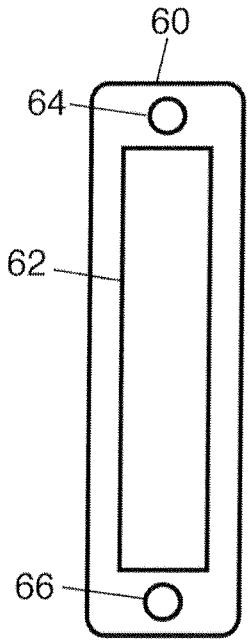
FIGS. 3A and 3B depict front and back views, respectively, of an existing garage door switch connected to an automatic door closer receiver in accordance with some embodiments of the present invention.
Figure 3B:
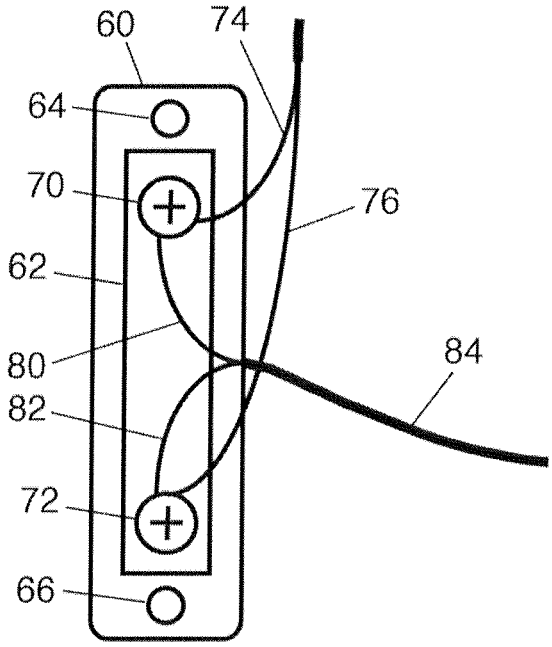

Turning now to FIGS. 3A and 3B, an example of an existing single-button garage door closer unit 60 is illustrated in front view (FIG. 3A) and rear view (FIG. 3B). The unit 60 has a push button 62 which is pressed by a user to open and close the door. The unit 60 may also include one or more mounting holes 64 and 66 or other attachment devices. A pair of electrical terminals 70 and 72, such as screws, are located on the unit 60 and may be located in the back of the unit 60. Wires 74 and 76 are connected to the terminals 70 and 72. The wires 74, 76 are used to send a signal, such as an open or close signal to the door closer (not shown). When the user presses the button 62, the unit 60 shorts across and electrically connects the terminals 70 and 72, which causes a signal to be sent to the door closer.

The receiver 14, FIG. 1, is connected to the unit 60 by an electrical cable 84, with one wire 80 in the cable 84 being connected to one of the terminals 70 and the other wire 82 being connected to the other terminal 72. The receiver 14 causes the door to close by shorting across the terminals 70 and 72, mimicking a manual press of the button 62.

In one embodiment of the installation of the receiver 14, the unit 60 is removed, and the wires 74 and 76 are loosened. The wires 80 and 82 from the receiver 14, FIG. 1, are connected to the terminals 70 and 72, and the terminals 70 and 72 are re-tightened with both the original wires 74 and 76 and new wires 80 and 82 from the receiver 14. The receiver 14 may be installed in addition to the existing unit 60 so that they are connected in parallel. Proper polarity of the wires 80 and 82 may be indicated by color-coding, for example using a red wire (e.g., 80) to be connected to the positive terminal 70 of the unit 60 (commonly brass, or gold colored), and using a black wire to be connected to the negative terminal 72 of the garage door opener switch 60 (commonly silver).

The description herein generically refers to closing the door 50, FIG. 2, by actuating the unit 60 using the receiver 14. It is important to note that the receiver 14 cause the door closer to activate by shorting the terminals 70, 72 after a pre-determined amount of time or according to other control schemes. Therefore, if the door 50 is open or partially open, the direction of travel of the door 50 is determined by the door closer. Some door closer models allow the door to be left partially open in either direction. Other models will only allow the door to be left partially open when the door was previously opening or traveling in the up direction. In some embodiments of the control device 10, if the receiver 14 activates the door closer and the door 50 opens instead of closes, the control device 10 will re-activate and close the door 50 within a predetermined period, such as 1 minute, because it still senses that the door 50 is open.

Figure 4A:
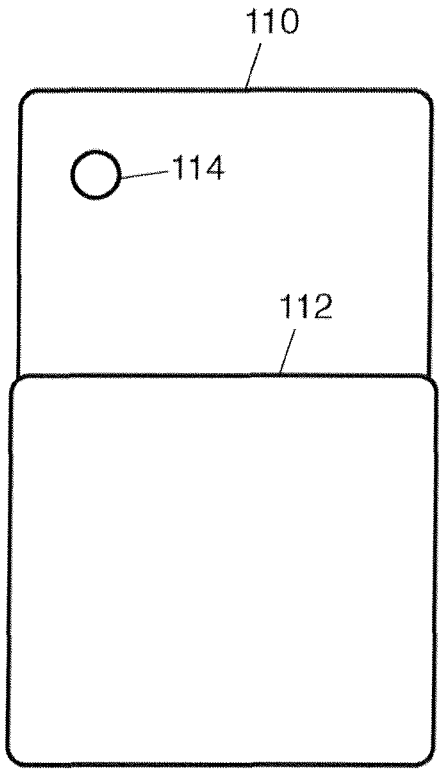
FIGS. 4A and 4B depict front and back views, respectively, of another existing garage door switch connected to an automatic door closer receiver in accordance with some embodiments of the present invention.
Figure 4B:
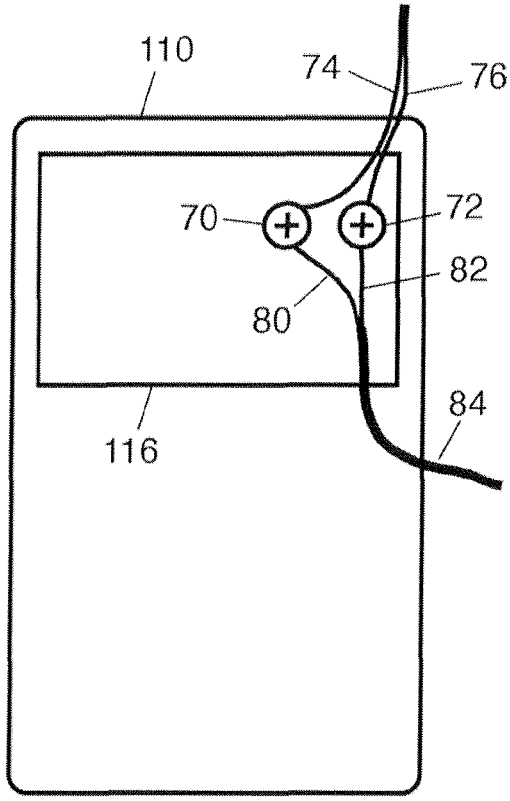

Reference is made to FIGS. 4A and 4B which show front and back plan views of different embodiments of an existing garage door opener unit 110. The unit 110 may include a multi-function switch with multiple buttons and indicators. In the embodiment of FIG. 4, the unit 100 includes a single switch 112, which is a push button switch, and a single indicator 114. The connection to the receiver 14 is similar to the embodiment of FIGS. 3A and 3B. The unit 110 is removed from the wall, exposing a circuit board or other access panel 116, and the wires 74 and 76 that control the door 50 being monitored are loosened. The wires 80 and 82 from the receiver 14 are connected to the terminals 70 and 72, and the terminals 70 and 72 are re-tightened with both the original wires 74 and 76 and new wires 80 and 82 from the receiver 14. It follows that the receiver 14 is electrically connected in parallel with the unit 110. In some embodiments, the above-described connection causes the receiver 14 to be connected in parallel with the switch 112.

The receiver 14 may be installed in addition to and/or adjacent the existing unit 110. Again, proper polarity of the wires 80 and 82 may be indicated by color-coding, for example using a red wire (e.g., 80) to be connected to the positive terminal 70 of the unit 110 (commonly brass, or gold colored), and using a black wire to be connected to the negative terminal 72 of the unit 110 (commonly silver). Using the proper polarity enables the receiver 14 to draw power from the wires 74, 76. The unit 110 may then be reattached as it was before the connection to the receiver 14.

Figure 5:
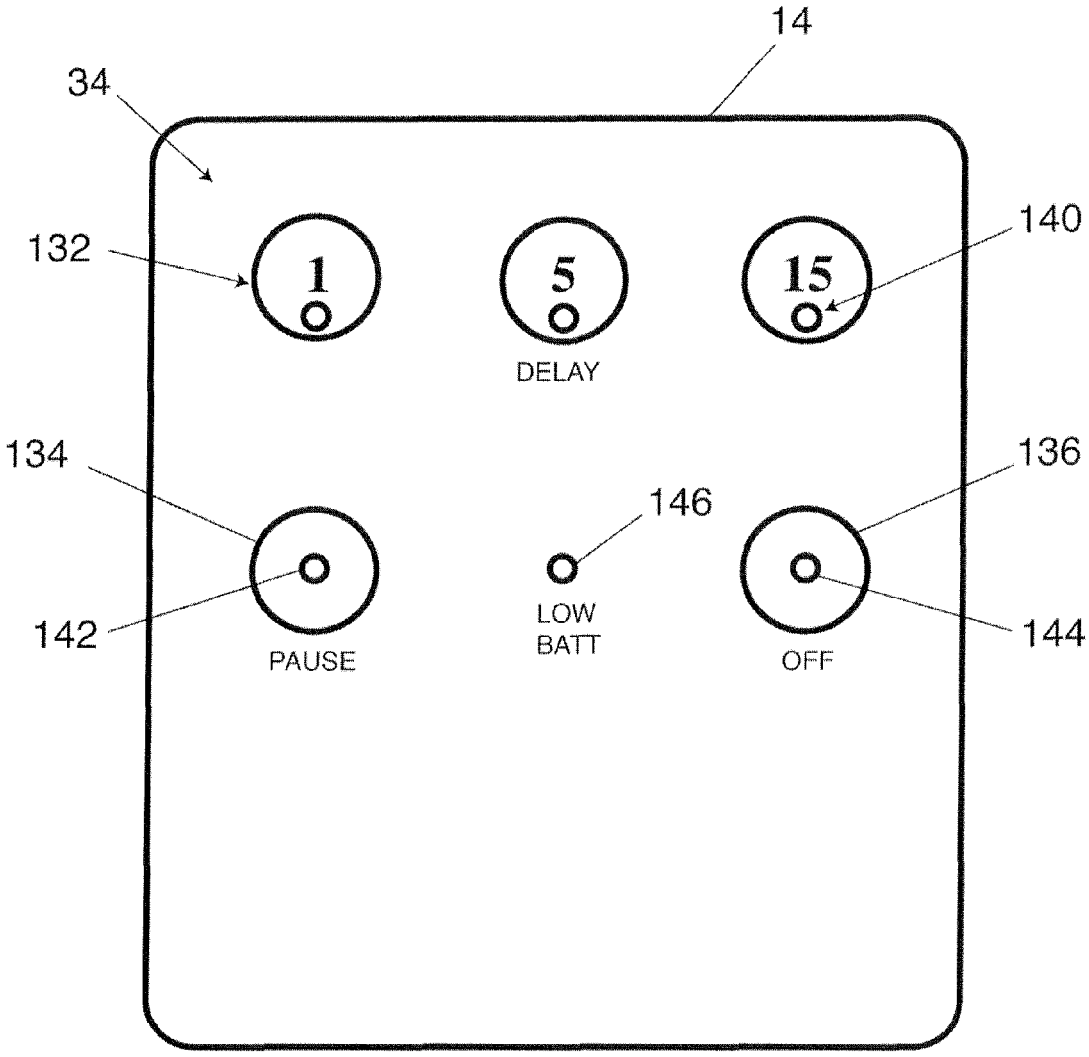
FIG. 5 depicts an embodiment of a receiver of FIG. 2 showing the user interface.

An example user interface 34 on the receiver 14 is illustrated in FIG. 5. The user interface 34 includes a plurality of delay buttons 132, a pause button 134, and an off button 136. The above-described buttons may be push-type switches that open or close a circuit upon being pressed. The delay buttons 132 activate the amount of time that the receiver 14 waits before it cause the door 50, FIG. 2, to close. In the embodiment of FIG. 4, there are three delays that a user may select, one minute, five minutes, and fifteen minutes. The pause button 134 activates a one-time pause that pauses the door closing procedures. More specifically, the transmission of signals to close the door 50 that are transmitted from the receiver 14 are paused when the pause button 134 is activated. The off button causes the receiver 14 to turn off.

In addition to the switches described above, the user interface 130 may have a plurality of lights or indicators 140, such as light-emitting diodes (LEDs). The delay buttons 132 are each associated with a delay indicator 140. The delay indicators 140 provide the user information as to how long of a delay will occur before the receiver 14 transmits a signal to the door closer causing the door to close. The pause switch 134 is associated with a pause indicator 142. The pause indicator 142 provides the user with information regarding the status of the pause function. If the pause indicator 142 is illuminated, the pause feature may be active so that the delays occur after the time set by the pause function. After the one-time pause, the receiver 14 may return to closing the door 50 after the delay has expired.

As described above, the receiver 14 also includes an off indicator 144. The off indicator may illuminate when the receiver 14 has been turned off. As described above, the receiver 14 may receive power from the door closer, so leaving the off indicator 144 illuminated will not adversely affect the receiver 14. The receiver of FIG. 5 includes a low battery indicator 146, that provides an indication when the battery 26 in the transmitter 12, FIG. 2, is low.

It is noted that the user interface 34 is not limited to the example activation time delays or even to the use of fixed discrete activation time delays. The user interface 34 may be adapted to allow specific time delays to be programmed, or to use triggering events other than elapsed time delays, such as time of day. Furthermore, the control device 10 may include any suitable interface, including keypads, rotary switches, slide switches, toggle switches, touch sensitive screens, text or graphical displays, remote control such as using a computer, cellular telephone or other devices, etc.

Figure 6:
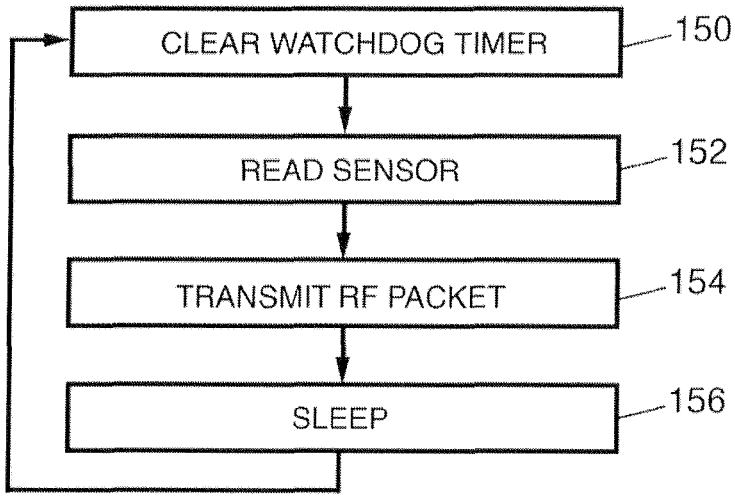
FIG. 6 depicts a flowchart of an example operation for determining and transmitting a door status in accordance with some embodiments of the present invention.

Having described the components of the control device 10, FIG. 1, the operation of the transmitter 12 and receiver 14 will now be described. Reference is made to FIG. 6, which is a flow chart illustrating the operation of an embodiment of the transmitter 12. In this embodiment, the microcontroller 22 in the transmitter 12 includes a watchdog timer that resets the microcontroller 22 if the watchdog timer is not cleared before it reaches a predetermined value. In this embodiment, the operation of the transmitter 12 includes periodically clearing the watchdog timer as described in step 150. The position sensor 20 is read at step 152 by the microcontroller 22. At step 154, the position or orientation information received from the position sensor 20 is transmitted to the receiver 14. The transmission may be by wireless communications, such as the use of a RF signal using the RF link 16. The RF signal may include a packet that includes a range of data, including for example, a door open or closed indication, and a low battery indicator. In one embodiment, the RF link 16 is address-based, with the transmitter 12 using the receiver 14 address to send the RF packet and with the receiver 14 responding to acknowledge receipt of the RF packet. The microcontroller 30 is then placed in a sleep mode to conserve power at step 156 until the process repeats. For example, in one embodiment, the microcontroller 30 is placed in the sleep mode for about eight seconds. Therefore, the door position data and other data is read and reported every eight seconds.

Figure 7:
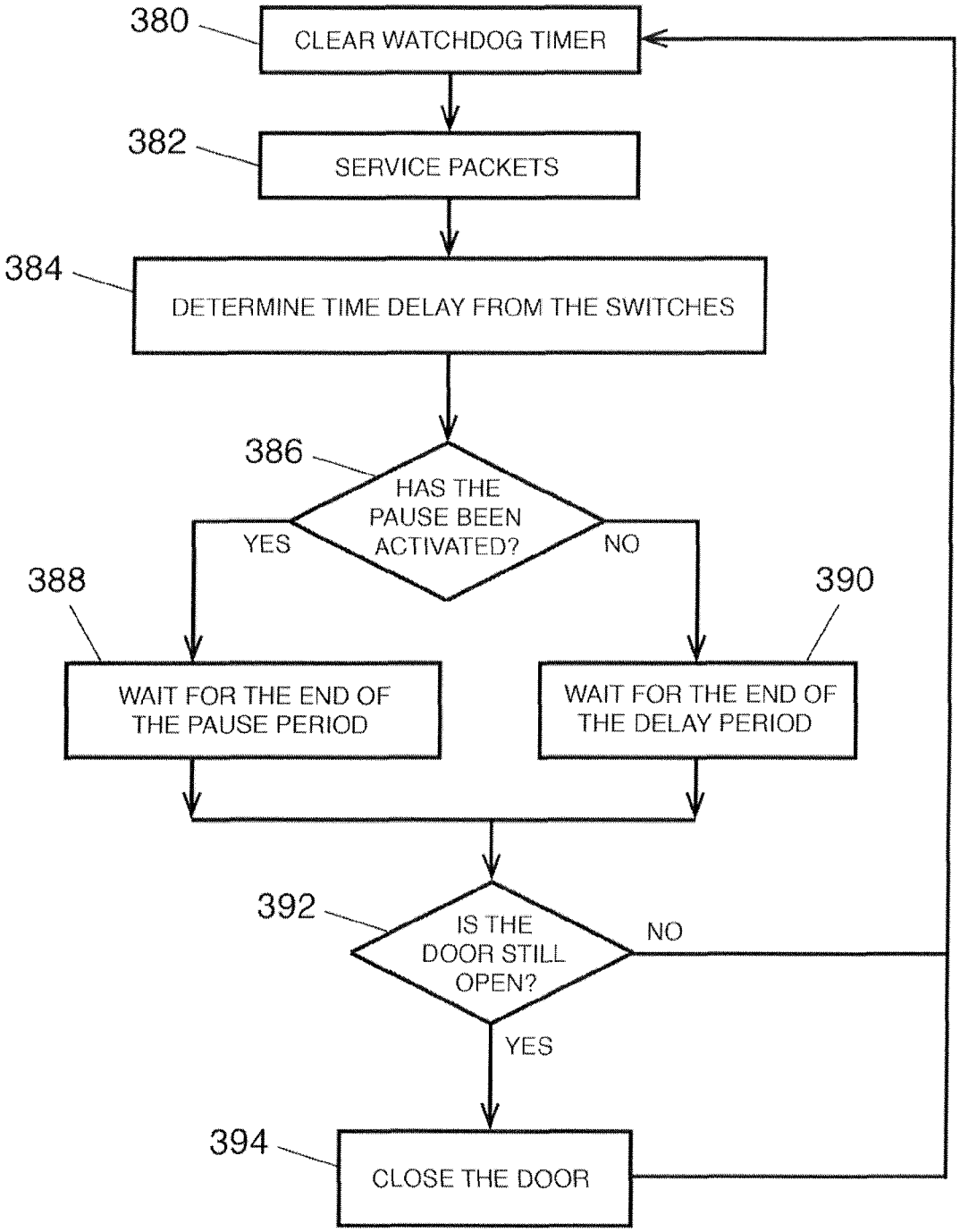
FIG. 7 depicts a flowchart of an example operation for automatically closing a door in accordance with some embodiments of the present invention.

Reference is made to FIG. 7, which is a flow chart illustrating the operation of one embodiment of the receiver 14. As with the transmitter 12, a watchdog timer in the microcontroller 30 is cleared at step 380. Data, such as RF packets, from the transmitter 12 are serviced at step 382 by acknowledging the packets to the transmitter 12 and reading the information contained in the packets. The data in the packets may include information such as the orientation of the door 50 and the status of a battery located in the transmitter 12.

In step 384 the delay as set by the switches 132, FIG. 5, is determined. In the embodiments described herein, there are three possible delays, one minute, five minutes, and fifteen minutes. It is noted that the delay may only be determined if the door 50 is determined to be open. Processing proceeds to decision block 386 where a determination is made as to whether the pause has been initiated. As described above, the pause is initiated by the user pressing the pause switch 134. If the pause has been initiated, a one-time pause is initiated, which keeps the door 50 open for the time set by the pause. In some embodiments, the pause is eight hours. After the pause period, normal operation of the receiver 14 works by closing the door 50 after the delay period set by the switches 134. If the decision of decision block 386 is affirmative, processing proceeds to step 388 and paused for the time of the pause. In some embodiments, the delay time is processed after the pause time. For example, if the delay is one minute and the pause set for a period of eight hours, the total time that the door will be open is eight hours and one minute. If the decision of decision block 386 is negative, processing proceeds to step 390 where processing is delayed for the amount of time set by the switches 132. It is noted that the delay is automatic and the pause is a one-time function set each time by the user.

Processing from both step 388 and 390 proceeds to step 392 where a determination is made as to whether the door 50 has been closed. In some situations, the door 50 may have been closed during the delay or the pause. For example, a use may have closed the door during the delay and/or pause period. If a signal is sent to the door closer and the door 50 is closed, the closed door 50 may open. By assuring that the door 50 is open, initiating the switch 62 will cause the door 50 to close. If the door 50 is closed, processing returns to step 380. If the door 50 is open, processing proceeds to step 394 where a signal is sent to close the door 50. After the door 50 has closed, processing returns to step 380.

Figure 8:
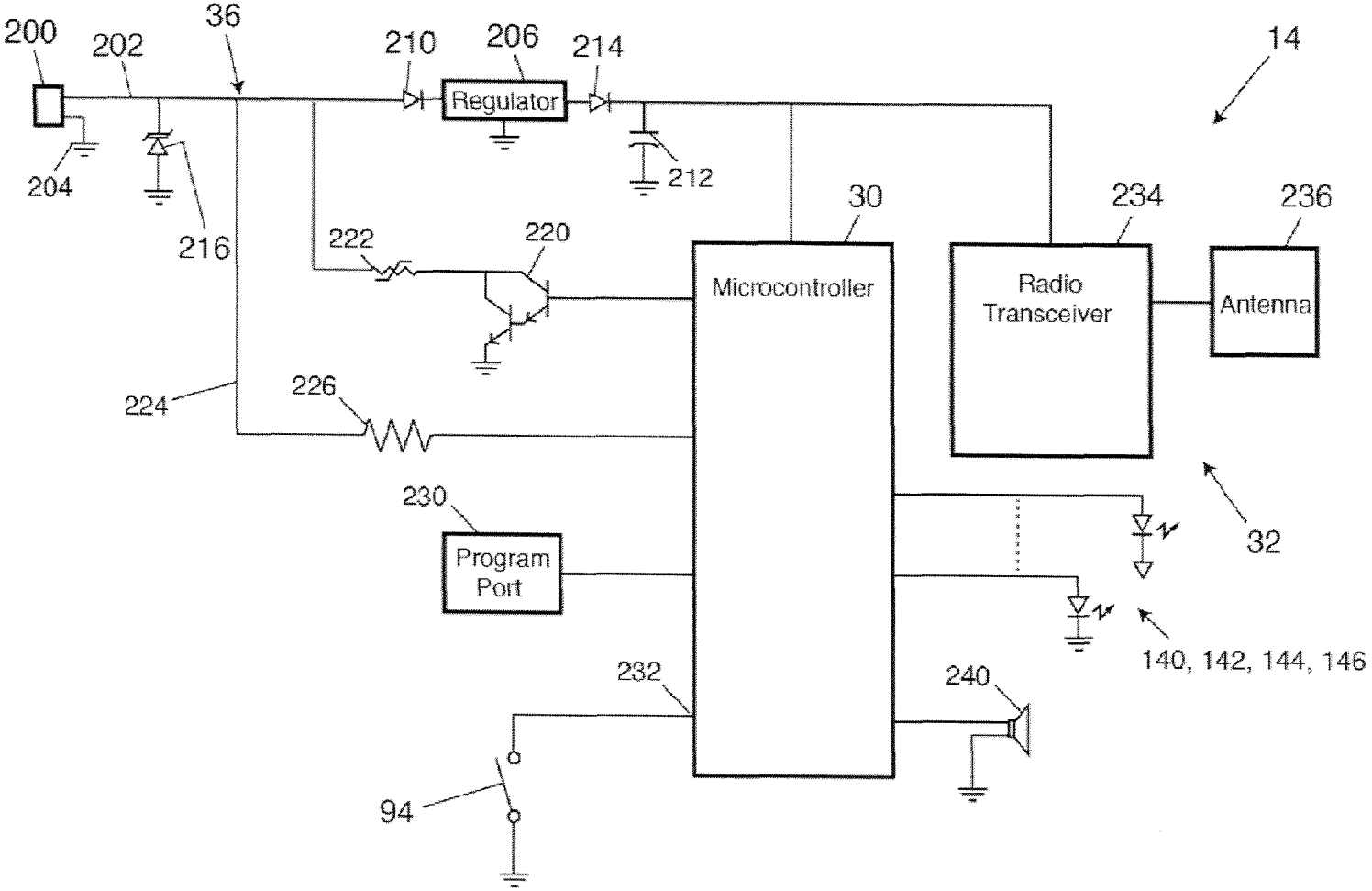
FIG. 8 depicts a block diagram of a receiver portion of an automatic door closer in accordance with some embodiments of the present invention.

Reference is made to FIG. 8, which is a schematic illustration of an embodiment of the receiver 14 in the automatic door closer 10. The microcontroller 30 and other active devices in the receiver 14 are powered in this embodiment by the power harness circuit 36. The power harness circuit 36 in the receiver 14 is connected to the existing garage door opener switch 60, FIG. 3B, or 110, FIG. 4B, through a two lead input 200, one lead of which is used as a voltage input 202 and the other lead is used as ground 204. The voltage input 202 is connected to a voltage regulator 206 through a diode 210. The output of the voltage regulator 206 is connected to a super-capacitor 212 (or other power storage device) through another diode 214. When the button (e.g., 62) is pressed, the diode 214 prevents current from flowing from the super-capacitor 212 back toward the input 200, maintaining power in the receiver 14 when the voltage input 202 is grounded through the button (e.g., 62). A transient voltage suppressor 216 may be connected to the voltage input 202 to protect the receiver 14 against voltage transients. Additional voltage regulators may be included as desired to provide multiple voltage levels in the receiver 14.

A switch 220 such as a Darlington transistor, MOSFET transistor or any other suitable switch is connected between the microcontroller 30 and the voltage input 202, enabling the microcontroller 30 to short the voltage input 202 to ground 204 to activate the garage door opener and close the overhead door 50. A polyswitch 222 may be connected between the switch 220 and the voltage input 202, providing overcurrent protection to the switch 220. The polyswitch 222 allows current to flow through the switch 220 until a current limit is reached, when the resistance of the polyswitch 222 increases and limits the current through the switch 220. Once the microcontroller 30 turns off the switch 220 and the polyswitch 222 cools, the resistance of the polyswitch 222 resets and returns to a normal low value. In other embodiments, a resistor or other device can be used to limit current through the switch 220, as long as it is high enough to trigger the garage door opener.

A feedback signal 224 from the voltage input 202 can be connected to the microcontroller 30, enabling the microcontroller 30 to detect when the button 62 in the garage door opener switch 60 is pressed by a user. The feedback signal 224 may pass through a resistor 226 to limit current if desired. The user interface 34 may be adapted for example to reset a timer in the microcontroller 30 when the user presses the button 62, starting the countdown to the activation time delay over.

A program port 230 may also be connected to the microcontroller 30, providing external access to change or update firmware in the microcontroller 30. Any suitable interface may be provided for the program port 230, based on the specific microcontroller 30 selected.

The RF link 32 connected to the microcontroller 30 may include a radio transceiver 234 and antenna 236, or other devices suitable for transmitting and receiving information on the RF link 16, FIG. 1. The wireless protocol for the RF link 32 may be handled internally in the microcontroller 30 or in an external RF device as desired. Although the RF link 32 in the receiver 14 primarily receives information from the transmitter 12, it may also transmit information to establish communication with the transmitter 12 according to the wireless protocol selected. Again, additional regulators may be included in the receiver 14 as needed to provide different voltage levels, for example if the microcontroller 30 and the transceiver 234 operate at different voltages.

Output devices such as the LEDs 140-146 and an audio device 240 are also connected to the microcontroller 30, enabling the microcontroller 30 to implement the user interface 34, FIG. 5, and provide information to the user as described above. Again, the receiver 14 is not limited to the example described herein, and may use alternate switching devices, power sources, controlling circuitry, etc.

Figure 9:
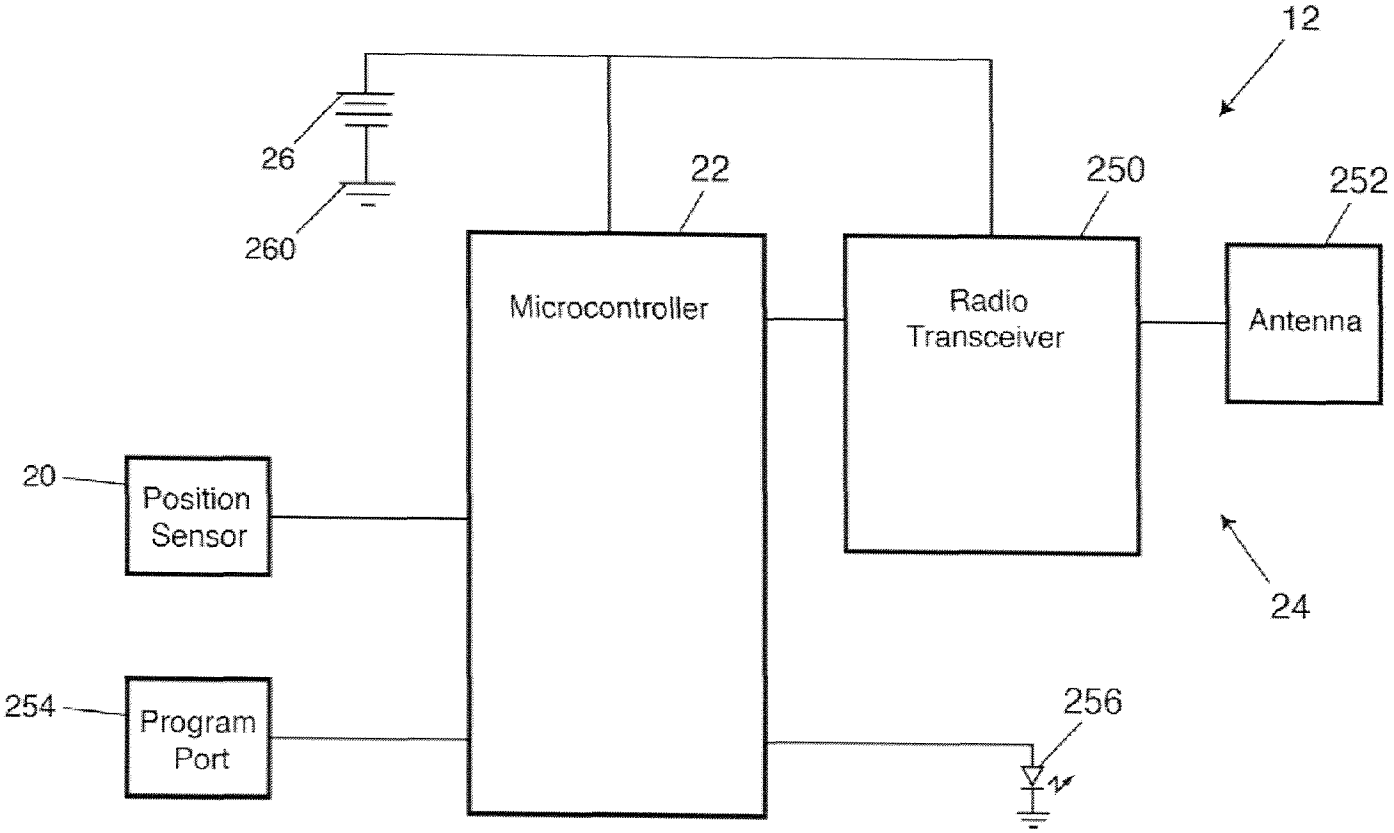
FIG. 9 depicts a block diagram of a transmitter portion of an automatic door closer in accordance with some embodiments of the present invention.

Reference is made to FIG. 9, which shows an embodiment of a transmitter 12 in the control device 10 in block diagram format. The position sensor 20 is connected to the microcontroller 22 to report the position of the door 50, FIG. 1. The microcontroller 22 may be adapted to monitor the sensor 20 continuously or periodically, for example on the order of seconds or tens of seconds. The microcontroller 22 in the transmitter 12 communicates wirelessly with the receiver 14 via the RF link 24, which may include a radio transceiver 250 and antenna 252. A program port 254 may be provided as in the receiver 14, enabling updates to firmware in the microcontroller 22. An LED 256 or other indicator may be connected to the microcontroller 22 so that it can provide visual feedback to the user about battery status or other conditions. An audible indicator may be used in addition to or in place of the LED 256. The microcontroller 22 and other active components in the receiver 14 may be powered by the power source 26, such as a battery, referenced to a local ground 260. As with the receiver 14, the automatic door closer 10 is not limited to the use of a microcontroller 22 and may be adapted to any of a variety of other suitable control systems.

The control unit 10 may be embodied as an add-on or accessory to an existing garage door opener, or may be built into a garage door opener. The control unit 10 increases security and convenience in operating a door such as an overhead or garage door, automatically closing the door if inadvertently left open or if intentionally and temporarily left open. The control unit 10 is simple to install and to operate, and can help to prevent costly break-ins.

In conclusion, the present invention provides novel systems, devices, methods and arrangements for automatically closing a powered door. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A control device that operates an automatic door closer, the control device comprising:

a sensor attached to the door, the sensor operable to transmit data indicative of the orientation of the door;

a receiver that is operable to:

receive the data from the sensor;

monitor the orientation of the door based on the data received from the sensor;

transmit a door closing instruction to the automatic door closer when the door orientation has been open for a first period;

pause the transmitting of door closing information to the automatic door closer for a second period in response to an input that is received from a user, the second period being a fixed time; and transmit the door closing instruction to the automatic door closer at the end of the second period;

transmit the door closing instruction to the automatic door closer using a second transmission when the data indicative of the orientation of the door indicates that the door has remained opened upon the first transmission of the door closing instruction.

2. The control device of claim 1 wherein the first period is selectable by a user input.

3. The control device of claim 1 wherein the receiver comprises a plurality of switches and wherein each switch sets a different first period.

4. The control device of claim 1 wherein the receiver is further operable to transmit the door closing instruction to the automatic door closer a second time when the data indicative of the orientation of the door indicates that the orientation of the door has not changed after the first transmission of the door closing instruction.

5. The control device of claim 1 wherein the automatic door closer includes a switch, wherein activation of the switch causes the orientation of the door to change, and wherein the receiver is operable to activate the switch and wherein activation of the switch constitutes the door closing instruction.

6. The control device of claim 5 and further comprising a switch and wherein the automatic door closer comprises a switch that sends instructions to change the orientation of the door, and wherein the switch of the controller is connected in parallel to the switch of the automatic door opener.

7. A method for operating an automatic door closer, the method comprising:

receiving door orientation data from a sensor attached to the door;

transmitting a door closing instruction to the automatic door closer when the door orientation data indicates that the door has been open for a first period; and pausing transmitting of the door closing instruction for a second period in response to a delay input, the second period being a fixed time; and transmitting the door closing instruction to the automatic door closer at the end of the second period;

monitoring the door orientation information after the transmitting of door closing instructions; transmitting the door closing instruction a subsequent time when the door orientation data indicates that the door orientation has not changed after a predetermined period after the transmission of the door closing instruction.

8. The method of claim 7, wherein the first period is selectable by a user.

9. The method of claim 7, and further comprising providing a user with a selection of first periods.

10. The method of claim 7, wherein the first period is shorter than the second period.

11. The method of claim 7, wherein the automatic door closer includes a switch, wherein activation of the switch causes the door to change orientation and wherein the transmitting comprises activating the switch.

12. The method of claim 7 and further comprising:

monitoring the door orientation information after the transmitting of the door closing instructions;

transmitting the door closing instruction a subsequent time when the door orientation data indicates that the door has remained open for a predetermined period after the initial transmission of the door closing instruction.

13. A garage door closer comprising:

a mechanical device that changes the orientation of a garage door;

a position sensor that is attachable to the garage door, the position sensor having an output that outputs data indicative of the orientation of the garage door;

a transmitter that transmits the orientation data from the position sensor;

a receive that receives the data indicative of the orientation of the garage door from the transmitter; the receiver connected to a control device that is operable to:

transmit a door closing instruction to the mechanical device when the door orientation has been open for a first period;

delay the transmitting of the door closing instruction to the mechanical device for a second period when a delay input is received from a user; and transmit a door closing instruction to the mechanical device in response to the end of the second period;

monitor the door orientation information after the transmitting of door closing instructions; transmit the door closing instruction a subsequent time when the door orientation data indicates that the door orientation has not changed after a predetermined period after the transmission of the door closing instruction.

14. The garage door closer of claim 13, wherein the control device is further operable to determine if the garage door is closed prior to transmitting a door closing instruction.

15. The garage door closer of claim 13, wherein the mechanical device comprises a switch, wherein activation of the switch causes the mechanical device to change the orientation of the door and wherein:

the control device is electrically connected to the switch; and transmitting a door closing instruction comprises activating the switch.

16. The garage door closer of claim 13, wherein the mechanical device comprises a switch, wherein activation of the switch causes the mechanical device to change the orientation of the door and wherein:

the control device is electrically connected to the switch; and transmitting a door closing instruction comprises simulating an activation of the switch.

17. The garage door closer of claim 13 wherein the control device is further operable to continually monitor the orientation of the door.

18. The garage door closer of claim 13 wherein the control device is electrically connected to an indicator that indicates the time of the first period.

* * * * *

UNITED STATES PATENT AND TRADEMARK OFFICE

CERTIFICATE OF CORRECTION

PATENT NO. : 8,839,557 B2
APPLICATION NO. : 13/734618
DATED : September 23, 2014
INVENTOR(S) : James Lloyd Sheldon It is certified that error appears in the above-identified patent and that said Letters Patent is hereby corrected as shown below:

ON THE TITLE PAGE

After "(71) Applicant:" delete "JCV Enterprises, Centennial, CO (US)" and insert therefor --James Lloyd Sheldon--

IN THE SPECIFICATION

Column 1, Line 15, After "such" delete "a" and insert therefor --as--

Column 5, Line 20, Delete "cause" and insert therefor --causes--

IN THE CLAIMS

Column 8, Line 57, After "period;" insert --and--

Column 9, Line 28, After "period;" insert --and--

Column 10, Line 9, Delete "receive" and insert therefor --receiver--

Column 10, Line 19, After "period;" insert --and--

Signed and Sealed this
Tenth Day of February, 2015

Michelle K. Lee

Michelle K. Lee
*Deputy Director of the United States Patent and Trademark Office*